US005310479A

United States Patent [19]

Audeh

[11] Patent Number: 5,310,479

[45] Date of Patent: May 10, 1994

[54] PROCESS FOR REDUCING THE SULFUR CONTENT OF A CRUDE

[75] Inventor: Costandi A. Audeh, Princeton, N.J.

[73] Assignee: Mobil Oil Corporation, Fairfax, Va.

[21] Appl. No.: 956,186

[22] Filed: Oct. 5, 1992

Related U.S. Application Data

[63] Continuation-in-part of Ser. No. 802,174, Dec. 4, 1991, abandoned.

[51] Int. Cl.[5] ..... C10G 19/02

[52] U.S. Cl. ..... 208/219; 208/3; 208/222; 208/370

[58] Field of Search ..... 208/222, 219, 3, 370

[56] References Cited

U.S. PATENT DOCUMENTS 3,163,593 12/1964 Webster et al. ..... 208/240
3,216,926 11/1965 Kurtz, Jr. et al. ..... 208/282
3,265,754 8/1966 Delassus et al. ..... 260/674
3,413,307 11/1968 Heimlich et al. ..... 260/329.3
3,725,253 4/1973 Yamada ..... 208/111
4,201,662 5/1980 Horton ..... 208/228

*Primary Examiner*—Helane Myers
*Attorney, Agent, or Firm*—Alexander J. McKillop; Malcolm D. Keen; Jessica M. Sinnott

[57] ABSTRACT

A process for reducing the aliphatic sulfur content of a crude oil in a production site is disclosed. A crude oil with a high aliphatic sulfur content is treated at ambient reaction temperature with an oxidant which comprises formic acid and hydrogen peroxide. Preferably, the crude is treated with an amount of the oxidant of about 2 moles of oxidant for each mole of aliphatic sulfur in the crude. Preferably reaction temperature ranges from about 30° F. to 100° F. The oxidant converts the aliphatic sulfur compounds of the crude to a water soluble phase which is separated from the crude oil in a water wash.

14 Claims, 1 Drawing Sheet

PROCESS FOR REDUCING THE SULFUR CONTENT OF A CRUDE

This is a continuation-in-part of copending U.S. patent application Ser. No. 07/802,174 filed on Dec. 4, 1991 now abandoned, which is incorporated herein by reference in its entirety.

FIELD OF THE INVENTION

The invention relates to a process for reducing the aliphatic sulfur concentration of a crude which can be performed on the production site. More specifically, the process involves treating a whole crude with an oxidant which includes formic acid and hydrogen peroxide, under ambient conditions, to convert the aliphatic sulfur-containing components of the crude to a phase which is easily separated from the whole crude oil.

BACKGROUND OF THE INVENTION

Sulfur is present in crudes in a wide range of both aliphatic and aromatic compound types. Moving crudes which contain high levels of sulfur through pipelines which are dedicated to crudes containing low levels of sulfur is not permitted and crudes that do not qualify as low sulfur crudes will have to be transported separately, a costly proposition.

Although various methods for desulfurization are known, their application is most practical in refineries and not in oil production sites because of the sophisticated equipment and materials required. For example, the process equipment utilized in catalytic hydrotreating, which removes sulfur, is costly and requires careful operation and maintenance which would be difficult and economically impractical to implement on the site of crude production. Additionally, these processes require hydrogen production which relates to still more costly process equipment. Since crude production facilities are often located in remote areas which, although equipped with certain crude treating equipment such as separators and precipitators, lack the sophisticated refinery operations, equipment and technology necessary to implement hydrotreating units.

It would be economically advantageous to reduce the sulfur content of the crude, prior to transport through the pipeline system to distant locations dedicated to the transportation of low sulfur containing crudes to reduce the costs associated with separate crude transport pipelines.

SUMMARY OF THE INVENTION

A practical way to process whole crudes to reduce the sulfur content prior to their transport through the crude pipeline system has now been found. According to the invention, a process is provided for modifying the sulfur-containing compounds of a whole crude to facilitate their removal from the crude at the crude production site. A crude rich in sulfur-containing compounds is treated with an oxidant which includes formic acid and peroxide. The sulfur-containing molecules in the crude are reacted under ambient temperature and pressure conditions with the oxidant in a mole ratio of about 2 moles of oxidant for each mole of the sulfur-containing compound contained in the crude. The aliphatic sulfur compounds are converted by the oxidant to a phase that can be easily separated from the crude by washing the crude with a solvent in which the converted aliphatic sulfur is soluble, such as water. Since water and water treatment facilities are, typically, readily available at oil production sites, water is a most practical wash fluid.

DETAILED DESCRIPTION OF THE INVENTION

Figure 1:
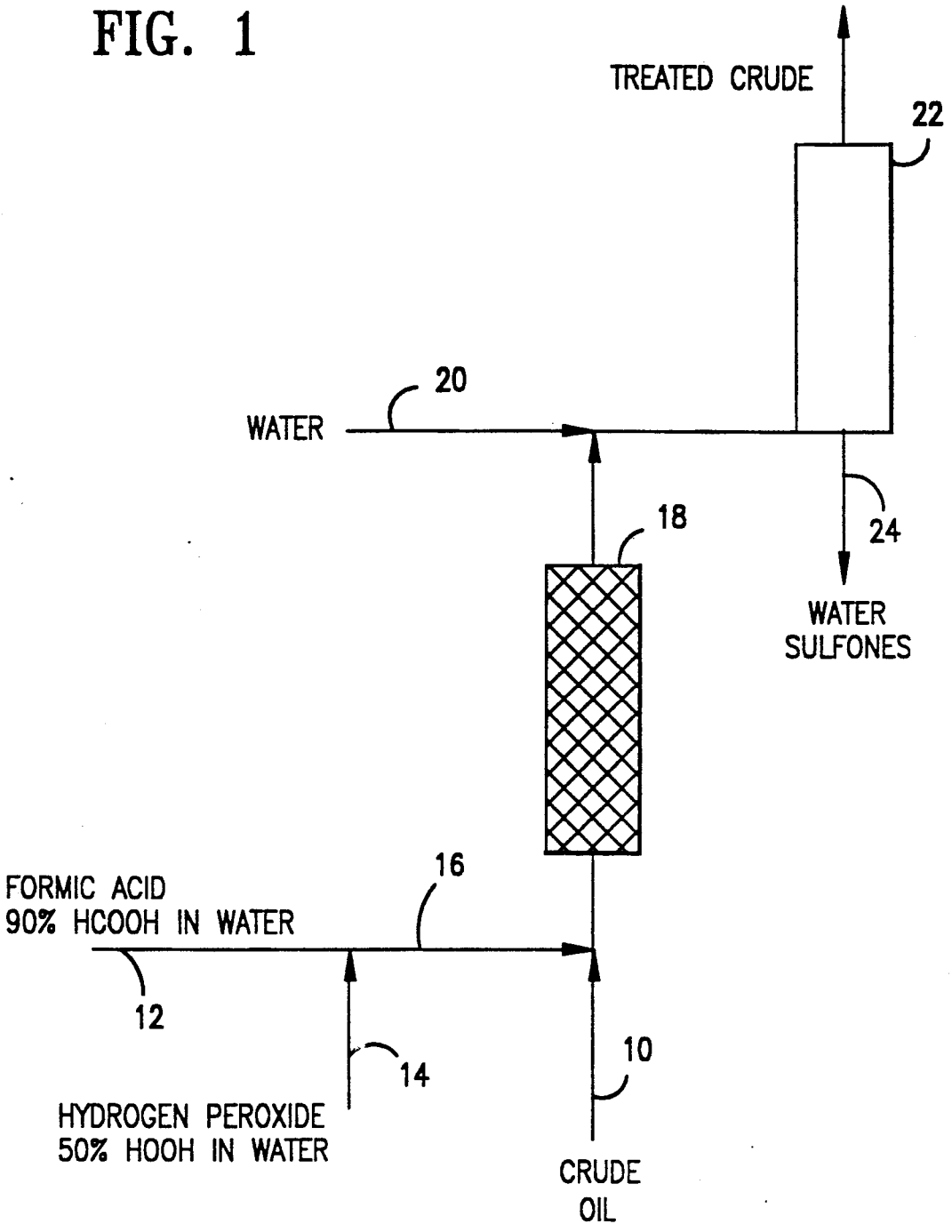
FIG. 1 is a simplified schematic flow diagram of the crude treating process of the invention.

An object of the invention is to reduce the sulfur content of crude oil prior to its transport to distant locations through a pipeline to avoid the creation of a separate pipeline system.

A feature of the invention is to selectively convert the aliphatic sulfur-compounds contained in a whole crude oil to a different phase in a manner which can be employed in a remote oil production site which lack sophisticated refining facilities.

Another feature of the invention is the discovery of an oxidant which has the ability to selectively oxidize the aliphatic sulfur compounds of the crude at ambient temperature to a water soluble internal phase which can be removed from the valuable components of the crude without diminishing the overall quality of the crude.

It is an advantage of the invention that when treating a crude oil with an oxidant the aliphatic sulfur compounds are oxidized and can be easily separated from the crude to produce a whole crude with a lower sulfur content.

In the preferred embodiment, the crude is analyzed to determine the sulfur content prior to treatment to determine the amount of oxidant necessary, since, preferably, 2 moles of oxidant per mole of aliphatic sulfur compound should be used.

The crudes which contain aliphatic sulfur compounds are of particular concern because the sulfur of the aliphatic compounds is more reactive than the sulfur of the aromatic compounds, an example of which is the thiophenes.

An oxidant composition has been discovered which effectively converts the aliphatic sulfur compounds in the crude to a water soluble form which is easily separated from the crude. The oxidant employed comprises formic acid and hydrogen peroxide. Other acids may be utilized; however, it was found that aliphatic carboxylic acids of higher molecular weight, such as acetic acid, are not practical because although they effectively oxidize the sulfur-containing compounds, they dissolve into the crude and are difficult to remove. Therefore, it is part of the discovery that the specific oxidant is not only an effective component for converting the sulfur-containing compounds, but is most easily separated from the treated crude. The proportion of formic acid to hydrogen peroxide suitable for making the oxidant, expressed in terms of mole ratio of hydrogen peroxide to formic acid, ranges from at most 1:4, to at least 4:1, preferably, 1:1. It is a further important discovery of the invention that the oxidant comprises both formic acid and hydrogen peroxide. It was found that neither the formic acid nor the hydrogen peroxide on its own facilitates removal of the aliphatic sulfur containing compounds. Moreover, although it is part of the invention that the oxidant comprises formic acid and hydrogen peroxide, the invention suitably may be practiced in the absence of any element which is not specifically disclosed herein. The oxidant is selective in converting the aliphatic sulfur compounds and; therefore, is most effective in treating crudes so that they will not contain the most reactive of the sulfur-containing compounds.

FIG. 1 is a diagram of the crude treatment process of the invention. A whole crude oil is charged to the process through line 10 where it is combined with the oxidant which, specifically, comprises formic acid and hydrogen peroxide. The formic acid component of the oxidant is conveyed to the process through line 12. Preferably, the formic acid is in an aqueous solution ranging from 50 to 96 weight % formic acid concentration, preferably ranging from 85 to 95 weight %, and even more preferably, a 90 weight % concentration. The peroxide is conveyed to the process through line 14. The peroxide is in an aqueous solution ranging from 30 to 90 weight % peroxide concentration, preferably from 45 to 55 weight %, even more preferably a 50 weight % concentration. The formic acid and peroxide are combined at juncture 16 and conveyed to the crude line 10 where the oxidant and the crude are together conveyed to in-line mixer 18. The crude and the oxidant are thoroughly mixed in the in-line mixer to oxidize the aliphatic sulfur compounds contained in the crude. Thereafter, water, introduced to the crude through line 20, is contacted with the crude to wash the converted sulfur from the crude. The treated crude is conveyed to settler 22. In the settler, the sulfur-containing compounds, specifically the aliphatic sulfur compounds which have been converted to a water soluble form, separate from the crude and are discharged via line 24. The treated crude is removed from the top of the settler and, having a reduced sulfur content, is ready for transport to distant locations through the crude transport pipeline.

The process can be used to treat a crude which has a sulfur content ranging from about 0.4% to 0.8% and more specifically the process can be used to treat a crude with a sulfur content greater than 0.5%, as determined by X-ray analysis. The invention effectively removes that portion of the sulfur which is in the aliphatic form.

In the sulfur conversion, it is believed that the aliphatic sulfur compounds, which have the general structural formula R-S-R, are oxidized by the oxidant to form water soluble sulfones which have the general structure:

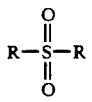

Where R represents aliphatic groups.

Mild process conditions are essential to the invention. Generally, however, since the process is conducted at the site of crude production, ambient conditions of temperature and pressure are utilized. It is an advantage of the invention that the process is effective at ambient conditions as this facilitates incorporation of the process in crude production facilities without additional process equipment needed to increase and maintain the temperature and pressure of the reaction. The contact time sufficient for reaction ranges from 15 to 40 minutes, preferably 20 to 25 minutes. The temperature conditions of reaction are typically at least about 30° F. (−1° C.) to 100° F. (37° C.), preferably ranging from about 45° F. to about 95° F. The pressure of reaction is preferably atmospheric i.e. about 1 atm.

EXAMPLES

Example 1

100 g of a crude oil which contained 0.18 g aliphatic sulfur was well mixed with 2.6 g of an aqueous solution prepared by mixing 100 g 90% formic acid in water with 130 g of 50% hydrogen peroxide in water. After this treatment the crude was washed with about 100 g of water. After the crude oil was separated from the water the aliphatic sulfur content was determined and was found to be 0.02%.

Example 2

Example 1 was repeated with the exception that only 2.6 g of water was added to the crude oil. After this treatment the crude was washed with about 100 g of water. No change in the aliphatic sulfur content of the treated crude was observed.

Example 3

Example 1 was repeated with the exception that only 2.6 g 50% hydrogen peroxide in water was added to the crude oil. After this treatment the crude was washed with about 100 g of water. No change in the aliphatic sulfur content of the treated crude was observed.

Example 4

Example 1 was repeated with the exception that only 2.6 g 90 % formic acid in water was added to the crude oil. After this treatment the crude was washed with about 100 g of water. No change in the aliphatic sulfur content of the crude was observed.

Example 5

100 g of a crude oil which contains 0.36 g aliphatic sulfur is well mixed with 5.2 g of an aqueous solution prepared by mixing 100 g 90% formic acid in water with 130 g of 50% hydrogen peroxide in water. After this treatment the crude is washed with about 100 g of water. After the crude oil is separated from the water the aliphatic sulfur content is determined and is found to be 0.02 %.

The results of Example 1 show that a combination of formic acid and peroxide effectively facilitates reduction of the aliphatic sulfur-containing compounds contained in a crude. The process is conducted at ambient temperature and pressure and is based on an aqueous system. Also it does not require extensive, costly process equipment; therefore, it would be easy to implement in current oil production facilities.

As demonstrated in Example 2, water alone does not effectively lower the aliphatic sulfur content. Additionally, as demonstrated in Examples 3 and 4, a combination of formic acid and hydrogen peroxide is required to effectively lower the sulfur content because, under the reaction conditions described in the examples, hydrogen peroxide alone has no effect (see Example 3) and formic acid on its own has no effect (see Example 4) on the aliphatic sulfur content of the crude.

The following examples demonstrate the sensitivity of the crude oil used in the test to higher reaction temperatures.

Example 6

100 g of a crude oil which contained 0.18 g aliphatic sulfur was well mixed with 2.6 g of an aqueous solution prepared by mixing 100 g 90% formic acid in water with 130 g of 50% hydrogen peroxide in water. The reaction mixture was heated to 40° C. After this treatment, the crude was washed with about 100 g of water. About ⅓ of the crude oil could not be separated from the oxidant and several grams of solid remained in the reaction vessel and could not be included in the product.

Example 7

100 g of a crude oil which contained 0.18 g aliphatic sulfur was well mixed with 2.6 g of an aqueous solution prepared by mixing 100 g 90% formic acid in water with 130 g of 50% hydrogen peroxide in water. The reaction mixture was heated to 75° C. During the treatment, large volumes of gas escaped from the reaction mixture. After this treatment, the mixture became very viscous and gell-like. Only a portion of the treated crude separated from the aqueous layer. The separated portion was washed with water but only about ½ of that portion of the crude was separable from the wash water.

Examples 6 and 7 demonstrate the importance of the lower temperatures to the invention. At reaction temperatures above about 40° C. (100° F.), some of the treated crude oil becomes sludge. A crude turned to sludge is a waste of a valuable resource and is useless for oil refining purposes.

What is claimed is:

1. A process for reducing the sulfur content of a crude oil rich in aliphatic sulfur compounds comprising:

mixing the crude oil rich in aliphatic sulfur compounds with an oxidant which comprises formic acid and peroxide in proportion of about 2 moles of oxidant for each mole of aliphatic sulfur in the crude at a temperature of reaction ranging from about 30° F. to below about 100° F. to convert the aliphatic sulfur compounds to a water soluble internal phase; and separating from the internal phase, a crude oil having a reduced aliphatic sulfur content.

2. The process as described in claim 1 in which the oxidant contains a mole ratio of formic acid to peroxide ranging from 1:4 to 4:1.

3. The process as described in claim 2 in which the oxidant contains a mole ratio of formic acid to peroxide of 1:1.

4. The process as described in claim 1 in which the formic acid is in an aqueous solution in a concentration ranging from 50 to 96 weight % formic acid.

5. The process as described in claim 4 in which the formic acid is in an aqueous solution in a concentration ranging from 85 to 95 weight % formic acid.

6. The process as described in claim 1 in which the peroxide is in an aqueous solution in a concentration ranging from 30 to 90 weight % peroxide.

7. The process as described in claim 6 in which the peroxide is in an aqueous solution in a concentration ranging from 45 to 55 weight % peroxide.

8. The process of claim 1 in which the temperature of reaction ranges from about 45° F. to about 95° F.

9. A process for treating a crude oil having a high sulfur content, in which at least a portion of the sulfur compounds are aliphatic sulfur compounds for transport from a production field to distant locations through a pipeline, comprising:

contacting a crude at a reaction temperature ranging from about 30° F. to below about 100° F. with an oxidant which comprises formic acid and peroxide in a mixing zone to obtain a treated crude oil in which at least a portion of the aliphatic sulfur compounds of the crude are converted to a water soluble internal phase; and separating the treated crude from the water soluble internal phase by washing the crude with water.

10. The process as described in claim 9 in which the sulfur compound content of the crude is at least 0.4%.

11. The process as described in claim 9 in which the oxidant contains a mole ratio of formic acid to peroxide ranging from 1:4 to 1:1 moles.

12. The process as described in claim 9 in which the temperature of reaction ranges from about 45° F. to 95° F.

13. The process as described in claim 11 in which the oxidant contains a mole ratio of formic acid to peroxide of 1:1 moles.

14. The process of claim 1 further comprising washing the crude with water and separating the water soluble internal phase from the crude.

* * * * *